US007554051B2

(12) United States Patent
Crispin

(10) Patent No.: US 7,554,051 B2
(45) Date of Patent: Jun. 30, 2009

(54) SENSOR ASSEMBLY

(75) Inventor: Phillipe Georges Crispin, Buckinghamshire (GB)

(73) Assignee: Peratech Limited, Durham (GB)

( * ) Notice: Subject to any disclaimer, the term of this patent is extended or adjusted under 35 U.S.C. 154(b) by 389 days.

(21) Appl. No.: 10/588,634

(22) PCT Filed: Mar. 18, 2005

(86) PCT No.: PCT/GB2005/001048

§ 371 (c)(1),
(2), (4) Date: Aug. 4, 2006

(87) PCT Pub. No.: WO2005/091322

PCT Pub. Date: Sep. 29, 2005

(65) Prior Publication Data

US 2007/0132736 A1 Jun. 14, 2007

(30) Foreign Application Priority Data

Mar. 18, 2004 (GB) ..... 0406080.2

(51) Int. Cl.
*H01H 1/02* (2006.01)

(52) U.S. Cl. ..... 200/512; 200/5 A; 200/86 R

(58) Field of Classification Search ..... 200/512, 200/85 R, 86 R, 86 A, 514–517, 5 A, 5 R
See application file for complete search history.

(56) References Cited

U.S. PATENT DOCUMENTS

| | | | | |
|---|---|---|---|---|
| 3,165,606 A | | 1/1965 | Cooper | |
| 3,243,540 A | | 3/1966 | Miller | |
| 3,617,666 A | | 11/1971 | Braue | |
| 4,066,851 A | | 1/1978 | White et al. | |
| 4,385,215 A | | 5/1983 | Lemberg et al. | |
| 4,687,885 A | | 8/1987 | Talmage, Jr. et al. | |
| 4,857,683 A | * | 8/1989 | Maser | 200/5 A |
| 6,373,475 B1 | | 4/2002 | Challis | |
| 6,452,479 B1 | * | 9/2002 | Sandbach | 338/208 |
| 6,504,531 B1 | * | 1/2003 | Sandbach | 345/173 |

FOREIGN PATENT DOCUMENTS

| | | | |
|---|---|---|---|
| EP | 0375832 | A | 7/1990 |
| FR | 2833403 | A | 6/2003 |
| GB | 2386339 | A | 9/2003 |
| WO | WO-00/72239 | A | 11/2000 |
| WO | WO-2005/001865 | A | 1/2005 |

* cited by examiner

*Primary Examiner*—Lincoln Donovan
*Assistant Examiner*—Marina Fishman
(74) *Attorney, Agent, or Firm*—Harness, Dickey & Pierce, P.L.C.

(57) ABSTRACT

A sensor comprising a plurality of layers, comprising a first mask layer; a second mask layer; a third mask layer disposed between said first and second mask layers and defining an aperture; and a first conductive layer disposed between the first mask layer and the third mask layer; a second conductive layer disposed between the second mask layer and the third mask layer; and a separator layer extending across the aperture in the third mask layer, said separator layer being configured to separate the first and second conductive layers when no pressure is applied to the sensor and to allow electrical contact between said first and second conductive layers during a mechanical interaction with said sensor, wherein each mask layer is formed from an electrically insulating material and has at least one side attached to another of said mask layers by adhesive.

20 Claims, 4 Drawing Sheets

SENSOR ASSEMBLY

BACKGROUND OF THE INVENTION

1. Field of the Invention

The present invention relates to a sensor assembly, in particular to the assembly of a sensor comprising a plurality of textile layers.

2. Description of the Related Art

A fabric sensor comprising a plurality of conductive textile layers is described in international patent publication WO 00/072239.

A factor in the particular construction of a sensor utilising conductive textile layers is the prevention of unwanted electrical contact within the sensor, for example resulting from insufficient separation between conductive layers or from frayed edges of a conductive textile layer.

A further example of a mechanical contact apparatus and a method of production is described in United Kingdom patent publication GB 2 386 339 A. According to the method of production described in this publication, individual layers are brought together in a stack arrangement to form an assembly, whereafter a sealing process is performed during which the edges of the assembly are encapsulated within an applied material.

BRIEF SUMMARY OF THE INVENTION

According to a first aspect of the present invention there is provided a sensor comprising a plurality of layers, comprising a first mask layer; a second mask layer; a third mask layer disposed between said first and second mask layers and defining an aperture; and a first conductive layer disposed between the first mask layer and the third mask layer; a second conductive layer disposed between the second mask layer and the third mask layer; and a separator layer extending across the aperture in the third mask layer, said separator layer being configured to separate the first and second conductive layers when no pressure is applied to the sensor and to allow electrical contact between said first and second conductive layers during a mechanical interaction with said sensor, wherein each mask layer is formed from an electrically insulating material and has at least one side attached to another of said mask layers by adhesive.

According to a second aspect of the present invention the sensor further comprises a conductive track for applying electrical potentials to said first conductive layer, wherein a portion of said conductive track is disposed directly on said first mask layer and a portion is positioned directly on the conductive layer.

According to a third aspect of the present invention the conductive layers of the sensor comprise conductive textile layers.

According to a fourth aspect of the present invention the mask layers of the sensor are formed from a plastics material.

According to a fifth aspect of the present invention the adhesive is a thermoplastic adhesive.

According to a sixth aspect of the present invention the separator layer of the sensor is formed from a mesh material.

According to a seventh aspect of the present invention there is provided a method of assembling a plurality of layers to form a sensor comprising, the steps of: obtaining a first mask layer and second mask layer; obtaining a third mask layer defining an aperture and formed from an electrically insulating material; locating a first conductive layer between the first mask layer and the third mask layer; locating a second conductive layer between the third mask layer and the second mask layer such that the third mask layer is disposed between said first and second mask layers, and attaching at least one side of each mask layer to another of said mask layers by adhesive, wherein a separator layer is located between said first and second conductive layers such that it extends across the aperture in the third mask layer, and wherein said separator layer is configured to separate the first and second conductive layers when no pressure is applied to the sensor and to allow electrical contact between said first and second conductive layers during a mechanical interaction with said sensor.

WRITTEN DESCRIPTION OF THE BEST MODE FOR CARRYING OUT THE INVENTION

FIG. 1

Figure 1:
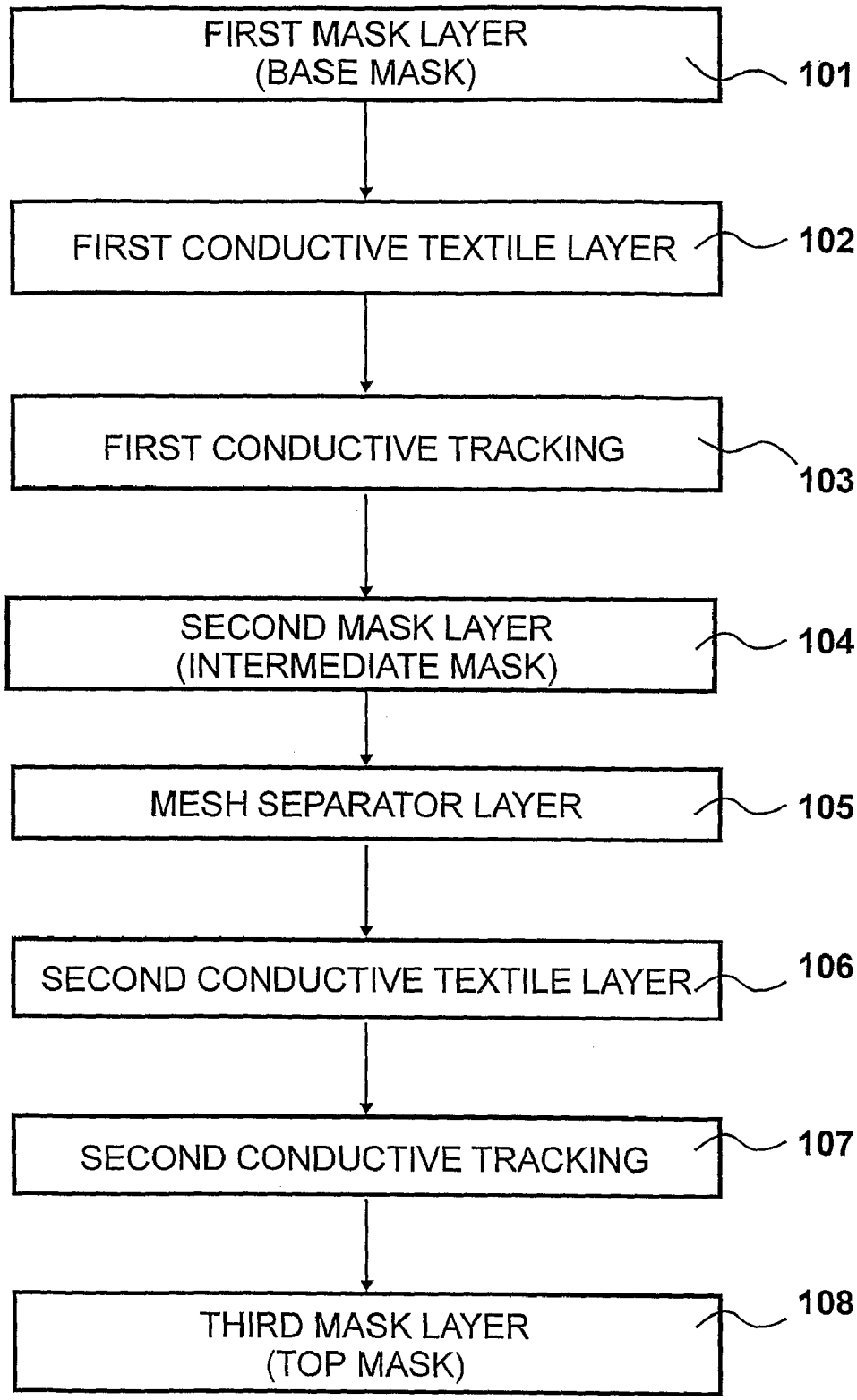
FIG. 1 is a flow chart illustrating an assembly order for layers of a sensor.

FIG. 1 is a flow chart illustrating an assembly order for layers of a sensor. In this example, the sensor is configured to generate signals in response to mechanical interactions, the signals representing X-axis and Y-axis co-ordinate data of mechanical interactions within the sensing area of the sensor. European patent publication no. EP 0 989 509 describes a sensor and electrical arrangement allowing the sensor to detect both the position of a mechanical interaction within the sensing area (X-axis and Y-axis data) and also an additional property of the mechanical interaction, for example the extent or pressure of the mechanical interaction (Z-axis data).

At step 101, a first mask layer (base mask) is positioned to receive further layers thereon. At step 102, a first conductive textile layer is placed upon the first mask layer (base layer). At step 103, first conductive tracking is located upon the first conductive textile layer. At step 104, a second mask layer (intermediate mask) is positioned over the first conductive textile layer and first conductive tracking, as described in further detail below with reference to FIG. 2. At step 105 a partially insulating mesh separator layer is located upon the second mask layer (intermediate mask). At step 106 a second conductive textile layer is placed over the mesh separator layer and at step 107 second conductive tracking is located upon the second conductive layer. At step 105 a third mask layer (top mask) is positioned over the second conductive textile layer and second conductive tracking to complete the layer assembly. In alternative orders of layer assembly, the conductive tracking may be laid down before or after the adjacent conductive textile layer.

FIG. 2

Figure 2:
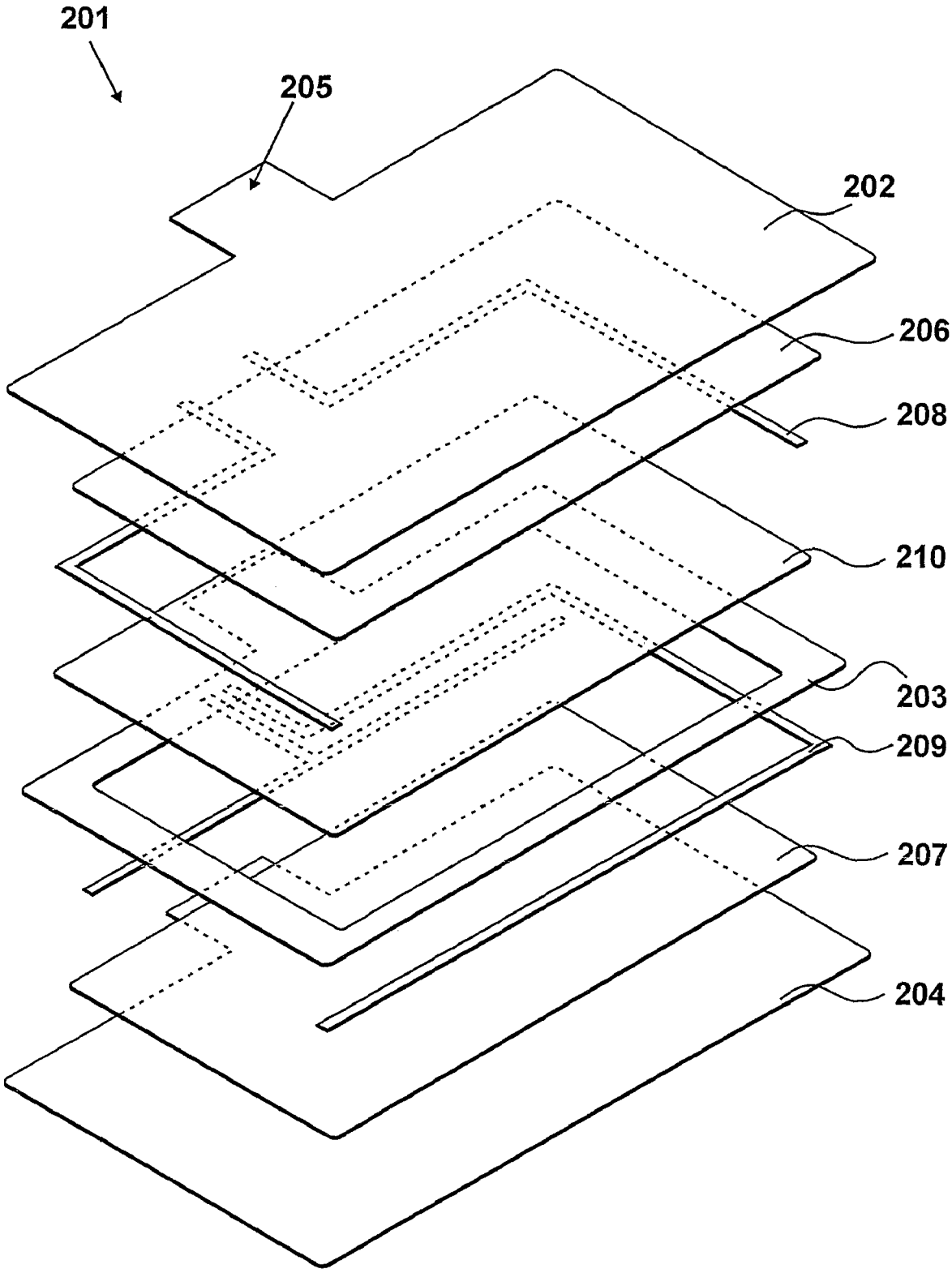
FIG. 2 shows an exploded view of component layers of a sensor having layers in the order of the layer assembly order of FIG. 1.

An example of a sensor having layers in the order of the layer assembly order of FIG. 1 is shown in FIG. 2.

FIG. 2 shows an exploded view of component layers of a sensor 201. Sensor 201 comprises three mask layers 202, 203 and 204. Each of these layers is fabricated from a polyurethane material coated on one side with a thermoplastic adhesive. Suitable material is sold under the trade mark Nylemark by Victory Designs Limited UK. Preferably, the melting point of the thermoplastic is within the range fifty degrees Celsius (50° C.) to one hundred and fifty degrees Celsius (150° C.), more preferably approximately one hundred and twenty degrees Celsius (120° C.).

Top mask 202 and base mask 204 are continuous layers of substantially the same dimensions and at least these two mask layers have an electrical connection mounting tab, for example tab 205 of mask layer 202. Intermediate mask 203 defines an aperture, or window, and has smaller dimensions in both axes than both top mask 202 and base mask 204.

Sensor 201 comprises two conductive textile layers, 206 and 207, which in this example are of substantially the same construction. The conductive textile layers 206, 207 have electrically conductive fibres incorporation therein. Preferably, these conductive textile layers 206, 207 have a woven or knitted construction but may have a felt or other non-woven construction, or a composite construction. The electrically conductive fibre may be for example, carbon coated fibre or carbon impregnated nylon 6 fibre.

Within sensor 201, a set of conductive tracks is located upon each conductive textile layer. The conductive tracks 208, 209 are metallised fabric, for example fabric coated with nickel or silver. Conductive tracks 208, associated with conductive textile layer 206, are configured to allow a voltage gradient to be established across the conductive textile layer 206 in a first direction across the sensor 201. Similarly, conductive tracks 209, associated with conductive textile layer 207 are configured to allow a voltage gradient to be established across the conductive textile layer 207, but in a second perpendicular direction across the sensor 201.

The final layer in the assembly is a partially insulating mesh separator layer 210. The term mesh is used to refer to a layer defining a plurality of apertures therein. This layer is configured to space the conductive textile layers 206, 207 apart when no pressure is applied to the sensor 201 and to allow electrical contact between the layers 206, 207 therethrough during a mechanical interaction.

Of the layers in the assembly of sensor 201, top mask 202 and base mask 204 have the greatest border dimensions. Intermediate mask 203 has smaller border dimensions and conductive textile layers 206, 207 and separator layer 210 are of the same or smaller dimensions such that the conductive textile layers 206, 207 and the separator layer 210 are dimensioned to fit within the border region around the window of intermediate mask 203.

FIG. 3

Figure 3:
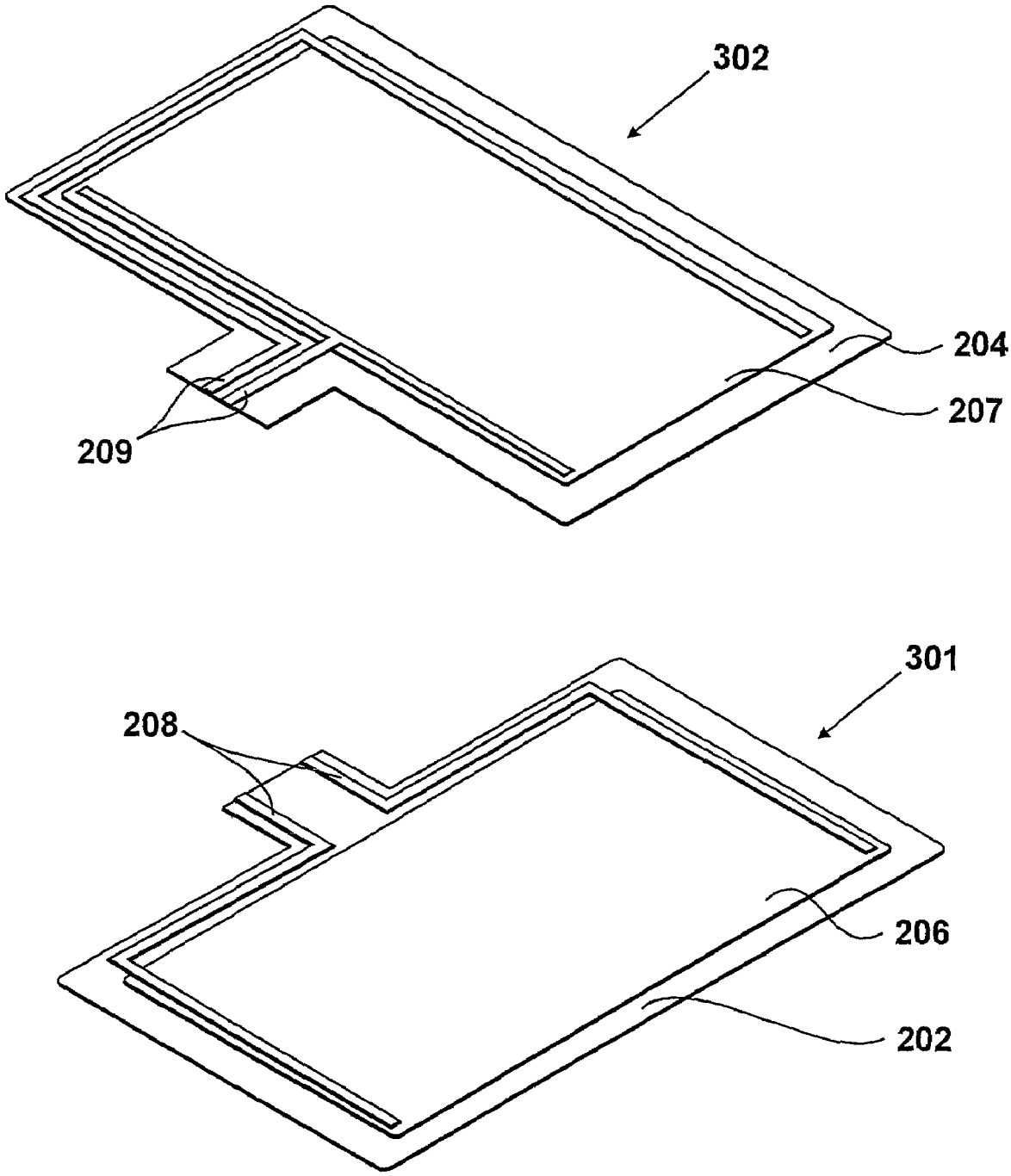
FIG. 3 illustrates two subassemblies of the sensor of FIG. 2.

The arrangement of the conductive tracks 208, 209 of sensor 201 with respect to neighbouring layers is illustrated in FIG. 3.

FIG. 3 shows a first subassembly 301 comprising top mask 202, conductive textile layer 206 and conductive tracks 208, and a second subassembly 302 comprising base mask 204, conductive textile layer 207 and conductive tracks 209. It can be seen that in each subassembly, the conductive tracks run from the electrical connection mounting tab around on the mask and then from the mask directly onto the conductive textile layer. In this example, the tracks are positioned one on each of opposite sides of the conductive textile layer. Thus, the masks each function as a substrate for portions of the conductive tracks.

FIG. 4

Figure 4:
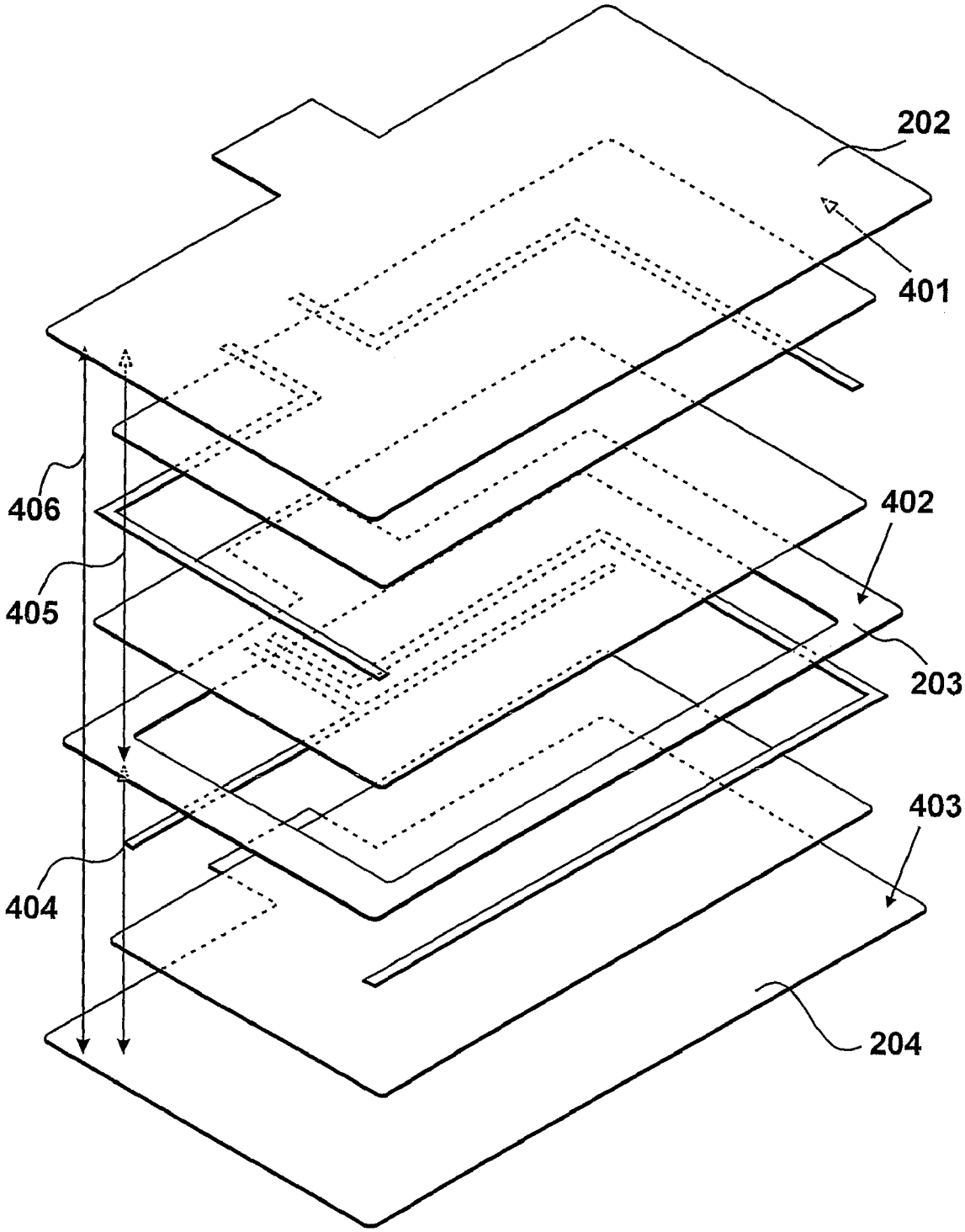
FIG. 4 illustrates an assembly technique of the component layers of the sensor of FIG. 2.

An assembly technique to assemble the component layers of sensor 201 is illustrated in FIG. 4. The orientation of top mask 202 is such that adhesive side 401 is facing downwards towards base mask 204, and the orientation of both intermediate mask 203 and base mask 204 is such that the adhesive side of each, 402 and 403 respectively, is facing upwards towards top mask 202.

With this arrangement, under the application of heat and pressure, base mask 204 bonds to intermediate mask 203, as indicated by arrow 404, encapsulating second conductive textile layer 207 and second conductive tracks 209 therebetween. Similarly, intermediate mask 203 and top mask 202 bond together, indicated by arrow 405, encapsulating first conductive textile layer 206, first conductive tracks 208 and separator layer 210 therebetween. Due to the border dimensions of top mask 202 and base mask 204 being greater than that of the other component layers, top mask 202 and base mask 204 bond together, indicated by arrow 406. This action seals the layers together into a layer assembly.

The masks of a layer assembly may provide more than one of the following functions: to provide insulation to prevent unwanted electrical contact within the assembly and/or to bond layers together and/or to provide a substrate for other components within the assembly and/or to protect the sensor against ingress of moisture or other contaminants and/or to provide an additional non-conductive area outside the sensing area of the sensor to allow, for example, the sensor to be physically connected to a case or other device.

To facilitate mounting of the sensor for use, for example by stapling to a base element, it is convenient for the sensor to have an extended, and in this example inactive, border around the edge of the sensor. To provide a stiff, robust edge, the footprint of the separator layer is extended beyond that of the conductive textile layers. The base mask and top mask then attach to each other through the separator layer during assembly.

In an alternative embodiment of the sensor, the top mask and the bottom mask each define an aperture, or window. This feature allows the sensor to breathe. According to a variant embodiment, the intermediate mask defines a plurality of apertures in place of a single window.

Alternatively, or in addition, one or more of the masks in the sensor has adhesive on both sides thereof. According to an embodiment of the sensor, the intermediate mask has adhesive on both sides thereof. This facilitates assembly of the component layers. In a further alternative embodiment of sensor, the top mask and base mask each have adhesive on both sides thereof. This feature facilitates the assembly of the sensor into another assembly, for example a car door panel.

It is to be appreciated that textile layers are prone to fraying following cutting, therefore appropriate allowances should be incorporated into the production of the sensor. A fraying tolerance should be assigned to the conductive textile layers and to the conductive tracking, and the fraying tolerances should be taken into account when organising these layers on a mask.

A practical application for such a sensor is a strip sensor used with a chair having a motorised moving component mechanism. The sensor is attached to the leading edge of the moving component, which may be located on the underside of the motorised chair, and is configured to provide input data to the motor control of the moving component mechanism. This arrangement provides a safety function to prevent the mechanism closing on an obstacle, such as an animal or a child. In a safety mode of operation, the sensor detects an obstacle in the path of the moving component and the motor control responds to stop movement of the moving component continuing in the same direction, to prevent crushing or trapping of the obstacle.

The invention claimed is:

1. A sensor including a plurality of layers, comprising:

a first mask layer;

a second mask layer;

a third mask layer disposed between said first and second mask layers and defining an aperture; and a first conductive layer disposed between the first mask layer and the third mask layer;

a second conductive layer disposed between the second mask layer and the third mask layer; and a separator layer extending across the aperture in the third mask layer, said separator layer being configured to separate the first and second conductive layers when no pressure is applied to the sensor and to allow electrical contact between said first and second conductive layers during a mechanical interaction with said sensor, wherein each mask layer is formed from an electrically insulating material and has at least one side attached to another of said mask layers by adhesive such that the edges of said first conductive layer are encapsulated between said first mask layer and said third mask layer and the edges of said second conductive layer are encapsulated between said second mask layer and said third mask layer.

2. The sensor according to claim 1, in which said third mask layer has smaller border dimensions than said first and second mask layers, and said first mask layer is attached to said second mask layer by adhesive.

3. The sensor according to claim 1, in which said sensor further comprises first conductive tracking configured to allow a voltage gradient to be established across said first conductive layer in a first direction, wherein a portion of said first conductive tracking is disposed directly on said first mask layer and a portion is positioned directly on the first conductive layer.

4. The sensor according to claim 3, wherein said first mask layer defines a first tab and said first conductive tracking runs from said first tab to said first conductive layer.

5. The sensor according to claim 3, wherein in which said sensor further comprises second conductive tracking configured to allow a voltage gradient to be established across said second conductive layer in a second direction that is perpendicular to said first direction, wherein a portion of second conductive tracking is disposed directly on said second mask layer and a portion is positioned directly on the second conductive layer.

6. The sensor according to claim 1, wherein said first and second conductive textile layers have electrically conductive fibres incorporated therein.

7. The sensor according to claim 1, wherein said first and second mask layers are continuous layers.

8. The sensor according to claim 1, wherein said mask layers are formed from a plastics material.

9. The sensor according to claim 1, wherein said mask layers are formed from a polyurethane material.

10. The sensor according to claim 1, wherein said adhesive is a thermoplastic adhesive.

11. The sensor according to claim 1, wherein said separator layer is formed from a mesh material.

12. The sensor according to claim 1, wherein the sensor is configured to generate signals in response to mechanical interactions, the signals representing X-axis and Y-axis coordinate data of mechanical interactions within the sensing area of the sensor.

13. A method of assembling a plurality of layers to form a sensor, comprising the steps of:

obtaining a first mask layer and a second mask layer, each formed from an electrically insulating material;

obtaining a third mask layer defining an aperture and formed from an electrically insulating material;

disposing said third mask layer between said first mask layer and said second mask layer;

locating a first conductive layer between the first mask layer and the third mask layer;

locating a second conductive layer between the third mask layer and the second mask layer, and disposing a separator layer between said first and second conductive layers such that it extends across the aperture in the third mask layer, said separator layer configured to separate the first and second conductive layers when no pressure is applied to the sensor and to allow electrical contact between said first and second conductive layers during a mechanical interaction with said sensor, wherein said method further comprises the step of:

attaching at least one side of each mask layer to another of said mask layers by adhesive such that the edges of said first conductive layer are encapsulated between said first mask layer and said third mask layer and the edges of said second conductive layer are encapsulated between said second mask layer and said third mask layer.

14. The sensor according to claim 5, wherein said second mask layer defines a second tab and said second conductive tracking runs from said second tab to said second conductive layer.

15. The sensor according to claim 5, wherein said first conductive tracking and said second conductive tracking are metallised fabric.

16. The sensor according to claim 6, wherein said first and second conductive layers have a woven or knitted construction.

17. The sensor according to claim 1, wherein the footprint of said separator layer is extended beyond that of said first conductive layer and said second conductive layer.

18. The sensor according to claim 10, wherein said thermoplastic adhesive has a melting point within the range of fifty degrees Celsius (50° C.) to one hundred and fifty degrees Celsius (150° C.).

19. The sensor according to claim 1, wherein at least one mask layer has adhesive on both sides.

20. The method according to claim 13, wherein said first and second conductive layers have electrically conductive fibres incorporated therein.

* * * * *